United States Patent [19]

Miller et al.

[11] Patent Number: 5,057,570

[45] Date of Patent: Oct. 15, 1991

[54] POLYVINYL ALCOHOL RESIN SOLUBLE IN HIGH SOLIDS AQUEOUS PAPER COATING COMPOSITIONS WITHOUT EXERNAL HEATING

[75] Inventors: Gerald D. Miller, Emmaus, Pa.; Michael M. Baas, KG Schalkwyk, Netherlands

[73] Assignee: Air Products and Chemicals, Inc., Allentown, Pa.

[21] Appl. No.: 537,386

[22] Filed: Jun. 13, 1990

[51] Int. Cl.[5] ..... C08L 29/04

[52] U.S. Cl. ..... 524/503; 524/425; 524/446; 524/557

[58] Field of Search ..... 524/503, 557, 425, 446

[56] References Cited

U.S. PATENT DOCUMENTS

| | | | |
|---|---|---|---|
| 3,272,675 | 9/1966 | Suzumura et al. | 524/557 |
| 3,652,313 | 3/1972 | Nagata et al. | 524/557 |
| 3,743,526 | 7/1973 | Zwahlen | 524/557 |
| 3,829,402 | 8/1974 | Zimmermann et al. | 524/557 |
| 4,094,694 | 6/1978 | Long | 524/557 |
| 4,542,178 | 9/1985 | Zimmermann et al. | 524/557 |
| 4,849,256 | 7/1989 | Newman et al. | 524/557 |

OTHER PUBLICATIONS

"Polyvinylalkohol in Gestrichenen Papiern—ein Vergleich Verschiediner Nobinder", published Nov. 1989, in vol. 48, Issue 25 of *Kunstharz-Nachrichten.*

Polymer Chemicals Technical Bulletin—Airvol ® 103 Dev. 203 and 107 Polyvinyl Alcohols: Protein Replacements in Conventional Paper Coating Formulations (G. D. Miller) APCI 1988 ©.

Oesterlin, H. G.; Schafer, H., "Polyvinyl Alcohol as a Carrier for Optical Brighteners in Coated Papers", *Das Papier* 32 (10A), V13-V19 (1978).

*Primary Examiner*—Joseph L. Schofer

*Assistant Examiner*—J. M. Reddick

*Attorney, Agent, or Firm*—Michael Leach; James C. Simmons; William F. Marsh

[57] ABSTRACT

A method for preparing a high solids, aqueous paper coating composition which comprises adding dry particulate solids of a partially hydrolyzed, low molecular weight polyvinyl alcohol to a high solids, aqueous paper coating composition and mixing without external heating until dissolved, preferably by mixing the polyvinyl alcohol solids into the aqueous pigment dispersion followed by the addition of binders and other additives to make the paper coating composition.

12 Claims, No Drawings

POLYVINYL ALCOHOL RESIN SOLUBLE IN HIGH SOLIDS AQUEOUS PAPER COATING COMPOSITIONS WITHOUT EXERNAL HEATING

BACKGROUND OF THE INVENTION

Paper coating compositions, or coating colors, are used by the paper industry to impart the desired strength and cosmetic properties to finished paper. The coating composition is an aqueous dispersion consisting mainly of mineral pigments like clay, calcium carbonate or titanium dioxide, and pigment binders of natural protein, for example casein or soy protein, starch or synthetic polymer emulsions. Styrene-butadienes and polyvinyl acetates are examples of such synthetic emulsion binders. Coating compositions may also contain low levels of additives, such as thickeners, humectants and lubricants.

Coating compositions are usually applied to a continuous web of material by high speed coating machines, such as blade coaters, air knife coaters, rod coaters and roll coaters. There are trends in the paper industry to use faster coaters to increase productivity and to use higher solids coating compositions to decrease drying costs and improve binder distribution which enhances paper quality.

Polyvinyl alcohol is commonly dissolved in water by heating and added to a high solids aqueous pigment dispersion which is then incorporated into a typical coating color composition. The polyvinyl alcohol portion is commonly used to "carry" fluorescent whitening agents (optical brighteners) in coating color compositions that result in the highest quality printing papers. It is known in the art to add partially or fully hydrolyzed lower molecular weight polyvinyl alcohols as aqueous solutions to such color compositions.

Low molecular weight, fully hydrolyzed polyvinyl alcohol is currently used world-wide as a minor (about 0.5–2 parts/100 parts pigment) but important ingredient in paper coating compositions to carry optical brighteners. Typically these compositions are designed for maximum solids. The currently used grades are 98+% hydrolyzed and have a degree of polymerization ranging from 100–600. These fully hydrolyzed, low molecular weight polyvinyl alcohols are "cooked out" in water. i.e., dissolved in water by heating, prior to incorporation into the pigment dispersion. Even though added as a solution at a low level based on total weight of dry ingredients, the additional water incorporated is considered undesirable since the goal is to higher and higher solids coating compositions.

SUMMARY OF THE INVENTION

The present invention provides a method for preparing a high solids, aqueous paper coating composition containing polyvinyl alcohol as a co-binder. A partially hydrolyzed, low molecular weight polyvinyl alcohol as dry particulate solids is mixed into the high solids aqueous paper coating composition without external heating preferably at high shear rates. The dry particulate solids can be mixed into an aqueous pigment dispersion which is then formulated with binders and other components to produce the paper coating composition.

The advantage of adding the partially hydrolyzed, low molecular weight polyvinyl alcohol as dry resin particles is that it completely solubilizes in the high solids aqueous paper coating composition or pigment dispersion without the need for external heating, i.e., no "cook-out" process is required thus saving time, steam energy costs and labor costs.

In addition, no extra water is introduced into the ultimate paper coating composition since the polyvinyl alcohol is added as a dry product and thus helps satisfy the industry's need to maximize solids in paper coating compositions for faster drying and faster machine speeds.

DETAILED DESCRIPTION OF THE INVENTION

The aqueous pigment dispersion would typically consist of clay or calcium carbonate or mixtures of the two at solids levels ranging from about 70 to 76%. In general, at least a portion of the pigment comprises calcium carbonate and for the clay portion, any of the clays customarily used for the paper coating, such as the hydrous aluminum silicates of the kaolin group clays, hydrated silica clays and the like can be used. In addition to the calcium carbonate and clay, there may be added other paper pigments, such as, for example titanium dioxide, blanc fixe, lithopone, zinc sulfide, or other coating pigments, including plastics, for example, polystyrene, in various ratios, for example, up to 50 wt %. preferably up to 35 wt % based on calcium carbonate and clay. Additionally, the composition may also contain other additives. such as zinc oxide and/or a small amount of a dispersing or stabilizing agent, such as tetrasodium pyrophosphate.

In contrast to the prior art practice of cooking low molecular weight, fully hydrolyzed polyvinyl alcohol into an aqueous solution for addition to the aqueous pigment dispersion, dry particulate low molecular weight partially hydrolyzed polyvinyl alcohol is simply added to the aqueous pigment dispersion and, preferably, is vigorously mixed at room temperature.

Partially hydrolyzed grades of polyvinyl alcohol are known to contain high percentages of cold water soluble fractions although they have, in the past, been erroneously labeled "cold water soluble" products. Typically, these products contain a small distribution of higher hydrolysis fractions which require heat to completely solubilize. For example, AIRVOL® 803 polyvinyl alcohol (87–89 mole% hydrolyzed; degree of polymerization of about 235) exhibits 93% solubles when slurried in 60° F. water for 45 minutes with agitation. The 7% insolubles would result in streaks if this aqueous "solution" were added to a pigment dispersion, incorporated into a paper coating composition and applied to paper on high speed coaters.

However, when the dry resin particles of AIRVOL 803 polyvinyl alcohol were added to a 76% solids aqueous calcium carbonate pigment dispersion at two parts per 100 parts calcium carbonate (dry/dry) and mixed with a high speed impeller at 1500 rpm for 5 minutes at room temperature as shown in Example 2, only 0.002% of the particulate matter was collected on a 270 mesh screen. This was only 1/4 the quantity found with a commercial cold water soluble starch (MYLBOND ES-E) currently sold in Europe as a cold water soluble dry resin additive. The calcium carbonate pigment dispersion itself resulted in no noticeable particles on the 270 mesh screen.

Suitable low molecular weight, partially hydrolyzed polyvinyl alcohols for the practice of this invention can be 70–90, preferably 85–90, and most preferably 87–89, mole% hydrolyzed and have a degree of polymerization (DPn) ranging from 50–600. preferably 185 to 255. Another means for assessing the DPn of the polyvinyl alcohol is ts viscosity as a 4 wt% aqueous solution at 20° C. Suitable polyvinyl alcohols would have a viscosity ranging from about 2 to 7. Such polyvinyl alcohols can be prepared by synthesis and saponification techniques well-known to those skilled in the art of manufacturing polyvinyl alcohol. A preferred polyvinyl alcohol having a DPn of about 235 and an 87–89 mole% hydrolysis is marketed by Air Products and Chemicals, Inc. under the trademark AIRVOL ® 803. The polyvinyl alcohol is incorporated into the high solids aqueous pigment dispersion without the need for "cook-out", i.e. external heating, by adding it as a dry resin advantageously with vigorous mixing.

The high solids aqueous pigment dispersion containing the polyvinyl alcohol as a co-binder can then be used to prepare paper coating compositions comprising (parts by wt): 100 parts pigment containing clay and/or calcium carbonate and 0 to 35 parts secondary pigment; 0.01 to 0.5 parts dispersing or stabilizing agent; 1 to 30 parts polymer binder emulsion (solids basis); 0.1 to 10 parts, preferably 0.5 to 2 parts, polyvinyl alcohol co-binder; 0.1 to 20 parts other co-binders; 0 to 0.2 parts defoamer, and sufficient water to provide the desired level of solids, usually about 45 to 70 wt %, preferably 60 to 70 wt % for high solids paper coating compositions.

Alternatively the particulate polyvinyl alcohol may be blended directly into the paper coating composition, i.e., the pigment dispersion containing the binder and any other additives, without the need for "cook-out", i.e. external heating.

Although vigorous mixing (high shear rate) is preferred, it is not essential. The time required to dissolve the polyvinyl alcohol solids is inversely related to the intensity of the mixing. In addition, the finer the particle size, the faster the particles will dissolve into the aqueous medium.

The coating compositions produced may be applied to fibrous paper webs using any of the conventional coating devices, including trailing blade coaters, air-knife coaters roll coaters, and the like.

EXAMPLE 1

This example shows the solubility of various Airvol PVOH's after 45 min of stirring 5 g of the polyvinyl alcohol (PVOH) in 100 ml water at 60° F. (16° C.) and screening the mixture through a 325 mesh sieve.

TABLE 1

| PVOH | mole % hydr | DPn | visc (cps) | % solubles 60° F./45 min |
|---|---|---|---|---|
| A-125 | 99.3+ | 1500 | 26–30 | 4 |
| A-165 | 99.3+ | 2000 | 55–65 | 3 |
| A-103 | 98+ | 235 | 3.2–4.2 | 18 |
| A-107 | 98+ | 500 | 5.4–6.5 | 21 |
| A-325 | 98+ | 1500 | 26–30 | 3 |
| A-350 | 98+ | 2000 | 55–65 | 3 |
| A-425 | 95.5–96.5 | 1500 | 25–29 | 36 |
| A-803 | 87–89 | 235 | 3–4 | 93 |
| A-205 | 87–89 | 500 | 5–6 | 94 |
| A-523 | 87–89 | 1500 | 22–26 | 88 |
| A-540 | 87–89 | 2000 | 40–50 | 79 |

EXAMPLE 2

Various binders were tested for solubility in a 76% calcium carbonate slip that comprised 2 parts binder per 100 parts calcium carbonate. The binders as dry particles were added slowly to the calcium carbonate slip, mixed for 5 minutes at 1500 rpm in a Cowles dissolver at 25° C., and then screened through a 270 mesh sieve. The % insolubles retained on the screen was recorded. The test results are shown in Table 2.

TABLE 2

| Run | Binder | % Insolubles | Comments |
|---|---|---|---|
| 1 | — | 0 | No particles on screen. |
| 2 | Mylbond ES-E starch | 0.009 | Small amount of particles on screen. |
| 3 | A-205s PVOH | 0.005 | Small amount of particles on screen. |
| 4 | A-803 PVOH | 0.002 | Small amount of particles on screen. |

A-205s PVOH is similar to A-205 PVOH except for having a finer particle size.

The data shows that A-205 and A-803 PVOH's when added as dry particulates to the pigment composition and mixed without external heating surprisingly went almost completely into solution in contrast to what would have been expected from the solubility data in Example 1.

EXAMPLE 3

This example shows the use of clay by itself and in combination with calcium carbonate as the pigment in a 70–72% solids dispersion. Table 3 identifies the pigment and dry particles of PVOH used (2 parts PVOH/100 parts pigment) and presents the data for the undissolved PVOH particles in the pigment dispersion after the mixing period. The amount of heat generated by the high shear Cowles mixer depends upon the viscosity and rheology of the ingredients, and upon the total time mixed. In these rather viscous systems temperatures typically reached 150° F. (66° C.) after 15 minutes.

TABLE 3

| Run | $CaCO_3$/Clay | PVOH | Cowles Min | % on 325 Mesh |
|---|---|---|---|---|
| 5 | 70/30 | — | 5 | 0.04 |
| 6 | 70/30 | A-803 | 2 | 0.54 |
| 7 | 70/30 | A-803 | 5 | 0.36 |
| 8 | 70/30 | A-803 | 15 | 0.08 |
| 9 | 70/30 | A-803 | 30 | 0.08 |
| 10 | 70/30 | A-103 | 15 | 34.4 |
| 11 | 70/30 | A-103 | 30 | 9.0 |
| 12 | 30/70 | — | 5 | 0.08 |
| 13 | 30/70 | A-803 | 15 | 0.11 |
| 14 | 0/100 | — | 5 | 0.03 |
| 15 | 0/100 | A-803 | 15 | 0.04 |

A-103—Airvol 103 PVOH (98+mole% hydrolyzed, DPn=235)

EXAMPLE 4

The performance of various PVOH's added as dry particles at 2 parts PVOH/100 parts pigment are shown by this example. The pigment dispersion was 70/30 calcium carbonate/clay at 71% solids and 25° C. Table 4 presents the data. In this example, no heat was imparted at the lower shear rates (200 rpm), et the A-803 PVOH showed only 0.021% insolubles on a 325 mesh screen.

TABLE 4

| Run | PVOH | Mixer Speed (rpm) | Mixer Time (min) | % Insolubles 325 MESH |
|---|---|---|---|---|
| 16 | A-803 | 1500 | 15 | 0.015 |
| 17 | A-523 | 1500 | 15 | 1.60 |
| 18 | A-540 | 1500 | 15 | 1.62 |

TABLE 4-continued

| Run | PVOH | Mixer Speed (rpm) | Mixer Time (min) | % Insolubles 325 MESH |
|---|---|---|---|---|
| 19 | A-425 | 1500 | 15 | 50.7 |
| 20 | A-803 | 200 | 30 | 0.021 |
| 21 | A-523 | 200 | 30 | 1.7 |
| 22 | A-540 | 200 | 30 | 2.0 |
| 23 | A-425 | 200 | 30 | 75.3 |

EXAMPLE 5

The effect of shear rate on mixing and dissolving Airvol 803 PVOH into a No. 1 clay pigment dispersion is shown in this example. The data in Table 5 shows that a high shear mixing process is preferred.

TABLE 5

| Run | % Solids | Parts PVOH/ 100 Parts Clay | Mixer Speed (rpm) | Mixer Time (min) | % Insolubles 325 MESH |
|---|---|---|---|---|---|
| 24 | 70 | 0 | 1500 | 5 | 0.001 |
| 25 | 70 | 2 | 1500 | 15 | 0.002 |
| 26 | 70 | 2 | 200 | 15 | 0.04 |
| 27 | 67 | 5 | 1500 | 15 | 0.01 |
| 28 | 67 | 5 | 200 | 15 | 0.68 |

STATEMENT OF INDUSTRIAL APPLICATION

The present invention provides a dry binder that can be added to an aqueous pigment dispersion or high solids aqueous paper coatings and solubilized without the need for external heating.

We claim:

1. In a method for preparing a high solids, aqueous pigment dispersion for use in a paper coating composition comprising mixing an aqueous solution of a polyvinyl alcohol co-binder with an aqueous pigment dispersion, the improvement which comprises adding the polyvinyl alcohol co-binder to the aqueous pigment dispersion as dry particulate solids, the polyvinyl alcohol being 85–90 mole% hyrolyzed and having a degree of polymerization ranging from 50 to 600 , and mixing without external heating.

2. The method of claim 1 in which the polyvinyl alcohol has a degree of polymerization ranging from 185 to 235.

3. The method of claim 2 in which the polyvinyl alcohol is 87–89 mole% hydrolyzed.

4. The method of claim 1 in which the mixing is performed at a high shear rate.

5. In a method for preparing a high solids, aqueous paper coating composition comprising pigment, polymer binder, polyvinyl alcohol co-binder and dispersing agent by mixing an aqueous solution of a polyvinyl alcohol co-binder with an aqueous dispersion containing pigment, polymer binder and dispersing agent, the improvement which comprises adding the polyvinyl alcohol co-binder to the aqueous dispersion as dry particulate solids, the polyvinyl alcohol being 85–90 mole% hydrolyzed and having a degree of polymerization ranging from 50 to 600, and mixing without external heating.

6. The method of claim 5 in which the polyvinyl alcohol has a degree of polymerization ranging from 185 to 235.

7. The method of claim 6 in which the polyvinyl alcohol is 87–89 mole% hydrolyzed.

8. The method of claim 6 in which the mixing is performed at a high shear rate.

9. A method for preparing a high solids, aqueous paper coating composition which comprises adding dry particulate solids of a partially hydrolyzed, low molecular weight polyvinyl alcohol to a high solids, aqueous pigment dispersion, mixing without external heating until dissolved, and adding binders and other paper coating composition additives, the polyvinyl alcohol being 85–90 mole% hydrolyzed and having a degree of polymerization ranging from 50 to 600.

10. The method of claim 9 in which the polyvinyl alcohol has a degree of polymerization ranging from 185 to 235.

11. The method of claim 10 in which the polyvinyl alcohol is 87–89 mole% hydrolyzed.

12. The method of claim 9 in which the mixing is performed at a high shear rate.

* * * * *